US005781691A

United States Patent [19]

Kwok

[11] Patent Number: 5,781,691

[45] Date of Patent: Jul. 14, 1998

[54] HAND HELD STEAM DISPENSING HAIR-CARE APPARATUS

[76] Inventor: Daniel S. C. Kwok, 61 Pau Chung Street, Tokwawan, Kowloon, Hong Kong

[21] Appl. No.: 684,768

[22] Filed: Jun. 24, 1996

[51] Int. Cl.[6] ..... A61H 33/12; A45D 1/04; A45D 6/06

[52] U.S. Cl. ..... 392/405; 219/222; 132/228

[58] Field of Search ..... 392/379, 383, 392/384, 385, 400, 404, 405, 406; 219/221, 222; 132/227, 228, 229, 232, 118, 211

[56] References Cited

U.S. PATENT DOCUMENTS

| | | | |
|---|---|---|---|
| 2,849,736 | 9/1958 | Kohle | 132/118 |
| 3,721,250 | 3/1973 | Walter et al. | 132/211 |
| 3,768,491 | 10/1973 | Barradas | 132/118 |
| 3,934,114 | 1/1976 | Godel et al. | 219/222 |
| 3,934,597 | 1/1976 | McNair | 132/222 |
| 4,032,747 | 6/1977 | Kunz | 219/222 |
| 4,426,567 | 1/1984 | Gugliotti | 219/222 |
| 5,263,501 | 11/1993 | Maznik | 132/211 |

*Primary Examiner*—Teresa J. Walberg
*Assistant Examiner*—Sam Paik
*Attorney, Agent, or Firm*—Ashen, Galant & Lippman

[57] ABSTRACT

What is disclosed is a hand-held steam dispensing apparatus having a removable water reservoir, the reservoir containing a diaphragm dividing the reservoir into a large chamber and a small chamber wherein water from the large chamber may flow quickly into the small chamber, but water in the small chamber is restricted from flowing into the large chamber, a spring biased bellows pump with two one-way valves for allowing water to be pumped out of the bellows into a heating enclosure when the bellows is compressed and for allowing water to fill the bellows when the bellows expands. The heating chamber is coated to cause the water to form a thin film whereupon the water is heated to form hot water vapor which then expands through a barrel into a perforated tube. The water vapor passes out of the perforations to provide hot water vapor to a user's hair.

10 Claims, 7 Drawing Sheets

HAND HELD STEAM DISPENSING HAIR-CARE APPARATUS

BACKGROUND OF THE INVENTION

1. Field Of The Invention

The present invention relates to a hair-care apparatus and, more particularly, to a hand held steam dispensing curling and brush apparatus.

2. Description Of The Prior Art

Generally, hair is often shaped to produce waves or curls by hand-held curling irons or hand-held hot air brushes. The curling iron curls hair primarily by the transfer of heat from a high temperature metallic rod. The hot air brush provides heated air to hair through small holes in the stem of the brush. While the popularity of curling irons and hot air brushes have grown, these devices leave hair with little luster because these devices damage the hair to which they are applied.

Prior art curlers using steam have not solved the problem because hair is still styled by the application of heat and not by warm water vapor. Typically, a user of a prior art device rolls a portion of his/her hair onto a cylindrical rod. Water vapor is created, passed through a fiber material, and then dispensed to the user's hair. The volume of warm water vapor is limited and typically is not evenly distributed along the rod. Thus, steam or hot water vapor is not the reason hair is styled. Instead, styling is accomplished by heat transfer from the rod. Thus, hair is still damaged even though some moisture is available.

The numerous prior attempts to provide an effective hair styling device has yet to produce an optimal system.

BRIEF DESCRIPTION OF THE INVENTION

The difficulties encountered by previous systems and devices have been overcome by the present invention. What is described here is a hand-held steam dispensing hair-care apparatus comprising a handle housing; a tube connected to the handle, the tube having a plurality of radial openings; means connected to the handle for communicating with a source of electric power; means removably engaged to the handle for containing water; means connected to the handle for forming a heating enclosure; means connected to the handle for communicating water from the water containing means to the heating enclosure means; means connected to the handle and to the electric power communicating means for heating the enclosure means; and means connected to the handle for communicating heated water vapor from the heating enclosure means to the tube whereby a user of the apparatus is able to provide heated water vapor to his/her hair in a safe and convenient manner.

An object of the present invention is to provide a device which delivers hot water vapor to a user's hair to allow the hair to be styled. Another object of the present invention is to provide a hair care, hot water vapor dispensing apparatus which may be operated easily by one hand. A further aspect of the present invention is to provide a hand-held steam dispensing hair-care apparatus which is efficient, relatively simple, cost-effective and reliable.

A more complete understanding of the present invention and other objects, aspects, aims and advantages thereof will be gained from a consideration of the following description of the preferred embodiments read in conjunction with the accompanying drawings provided herein.

DESCRIPTION OF THE PREFERRED EMBODIMENT

Figure 1:
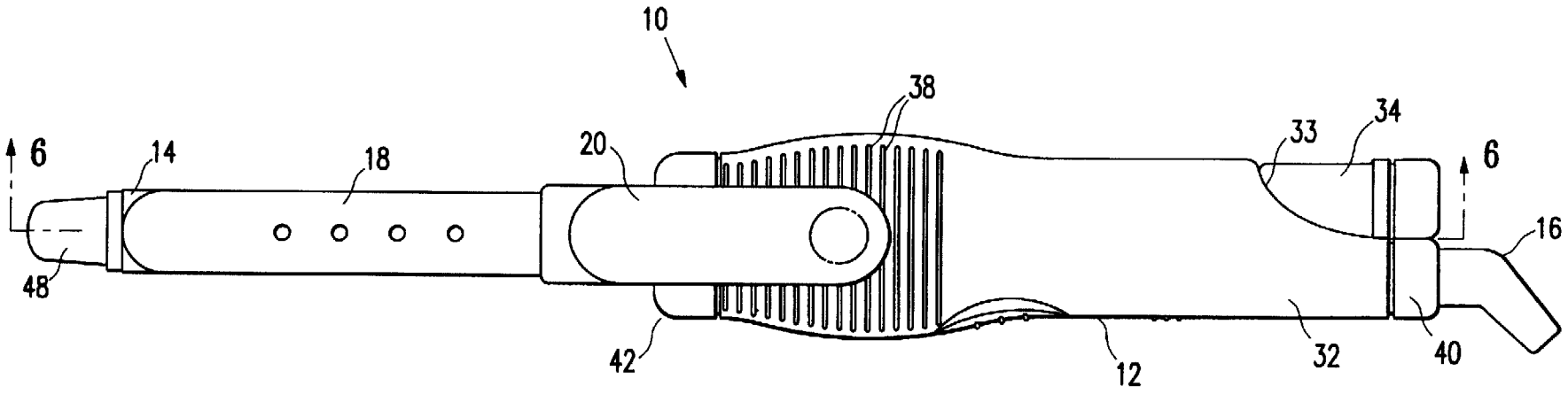
FIG. 1 is a top elevational view of the hand-held steam dispensing hair-care apparatus illustrating a curling attachment.

While the present invention is open to various modifications and alternative constructions, the preferred embodiments shown in the drawings will be described herein in detail. It is to be understood, however, that there is no intention to limit the invention to the particular forms disclosed. On the contrary, the intention is to cover all modifications, equivalences and alternative constructions falling within the spirit and scope of the invention as expressed in the appended claims.

Referring first to FIGS. 1–4, there is shown two variations of a hand-held steam dispensing hair-care apparatus 10. In the first variation, the apparatus includes a housing in the form of a handle 12 to which is attached a perforated tube 14. At the opposite end of the handle is the base of an electrical cord 16.

Figure 2:
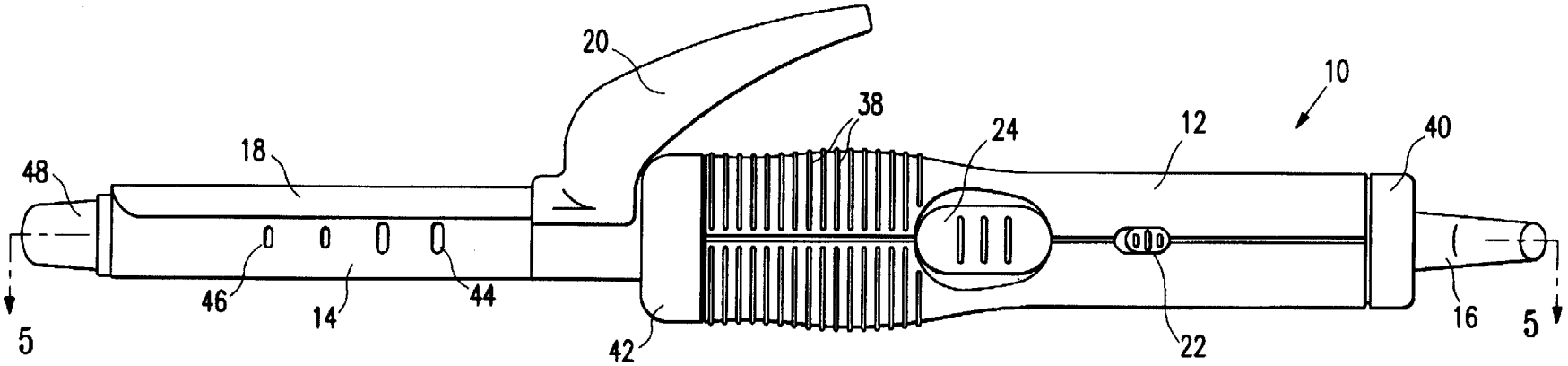
FIG. 2 is a side elevational view of the hand-held steam dispensing hair-care apparatus shown in FIG. 1.
Figure 3:
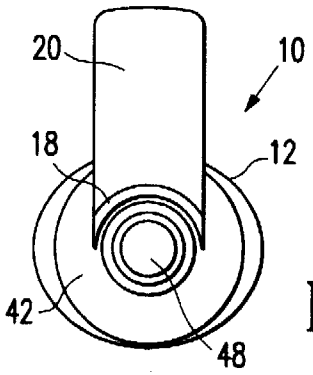
FIG. 3 is a front elevational view of the hand-held steam dispensing hair-care apparatus shown in FIGS. 1 and 2.

Mounted to the FIGS. 1–3 variation is an elongated arcuate element commonly called a clipper 18 to which is attached a clipper lever 20. The clipper lever allows the user to pivot the clipper away from and back toward the tube 14. Also shown is an on-off switch 22 and a steam activation switch 24.

Figure 4:
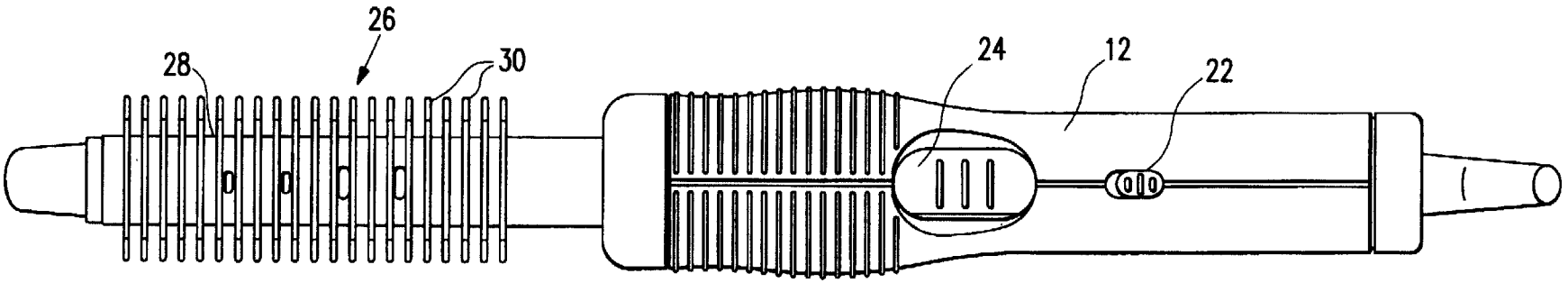
FIG. 4 is a side elevational view of the hand-held steam dispensing hair-care apparatus illustrating a brush attachment.

In the FIG. 4 embodiment, the tube-clipper-clipper lever combination has been replaced with a tube brush 26 in the form of a perforated tube 28 to which is attached a plurality of spaced apart discs 30.

In general operation of the FIGS. 1–3 embodiment, a user manipulates the on-off switch 22 to the "on" position. This will cause water in the handle to be heated. Thereafter, the user pivots the clipper 18 away from the tube 14, wraps hair around the tube, releases the lever 20 to sandwich the hair between itself and the tube and, thereafter, activates the steam switch 24 to cause heated water vapor to be directed through the perforations of the tube 14 and to moisten the hair wrapped around the tube.

In the FIG. 4 embodiment, the user activates the steam switch 24 while stroking his/her hair with the tube brush 26.

In more detail, the housing handle has a generally tubular portion 32 with an opening 33 to removably engage a water reservoir 34. The housing handle includes a series of spaced ribs 38 to facilitate handling of the apparatus. At the end of the handle, nearest the electric cord is a base cap 40 while at the opposite end of the handle is an end cap 42. The tubular portion and the two caps form an enclosure for various elements which are internal of the handle and which are described below.

Continuing beyond the end cap 42 is the perforated tube 14 which has a series of large perforations or openings 44 located closer to the handle and a plurality of small perforations or openings 46 spaced at a greater distance from the handle. At the far end of the perforated tube is a tip cap 48. The tip cap is heat insulated so that it may be touched by a user even when the apparatus is in its "on" mode.

The handle portions and the three caps may be made of polycarbonate such as Lexan number 241 manufactured by General Electric of Japan or Makrolon number 2405 manufactured by Bayer of Germany. The clipper may be of aluminum while the lever may be made of ABS resin. The resin may be purchased from Cyolac of the United States under its designation GPM 5500.

Figure 5:
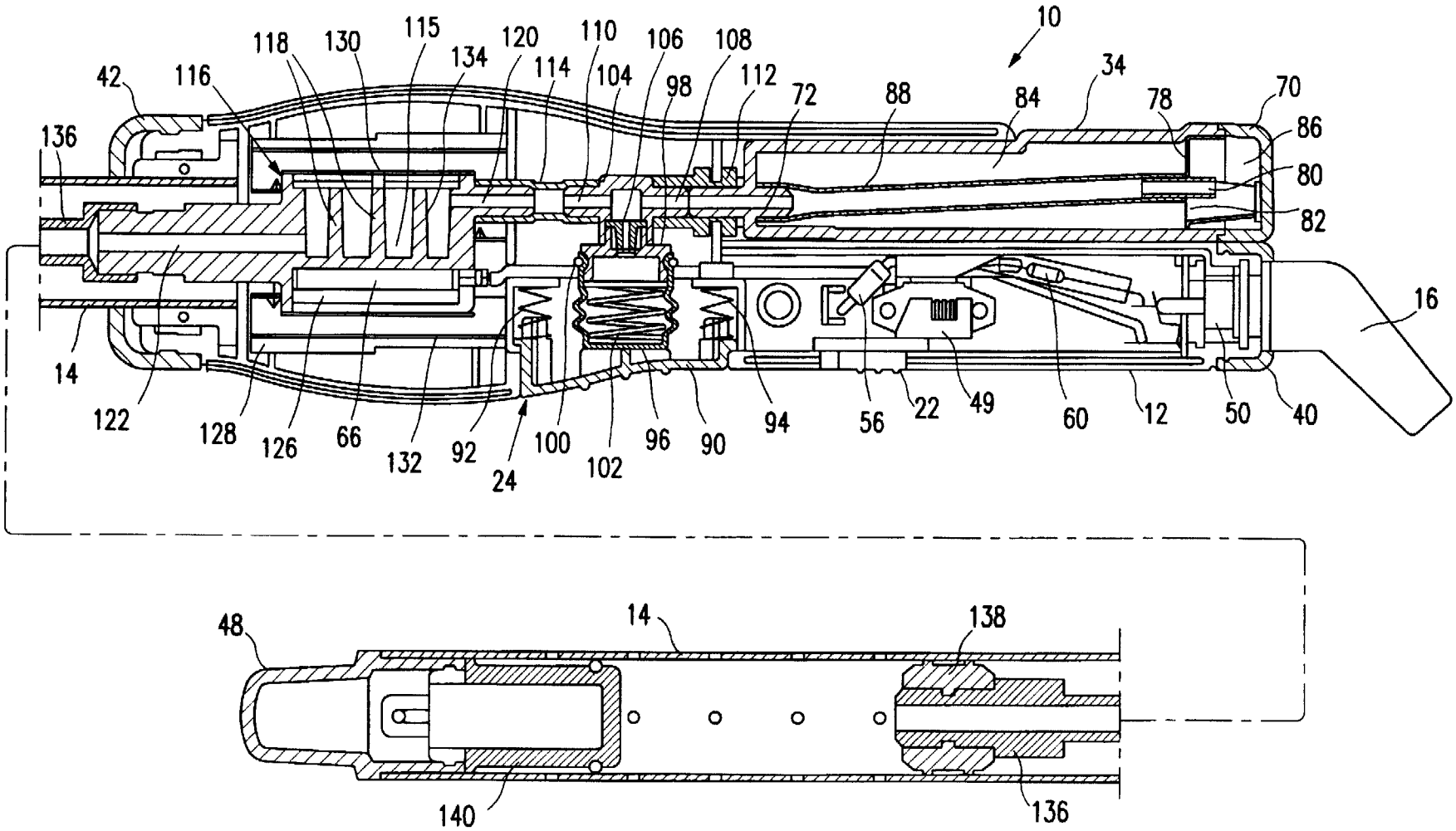
FIG. 5 is a sectional elevational view of the apparatus of FIGS. 1, 2 and 3 taken along line 5—5 of FIG. 2.
Figure 8:
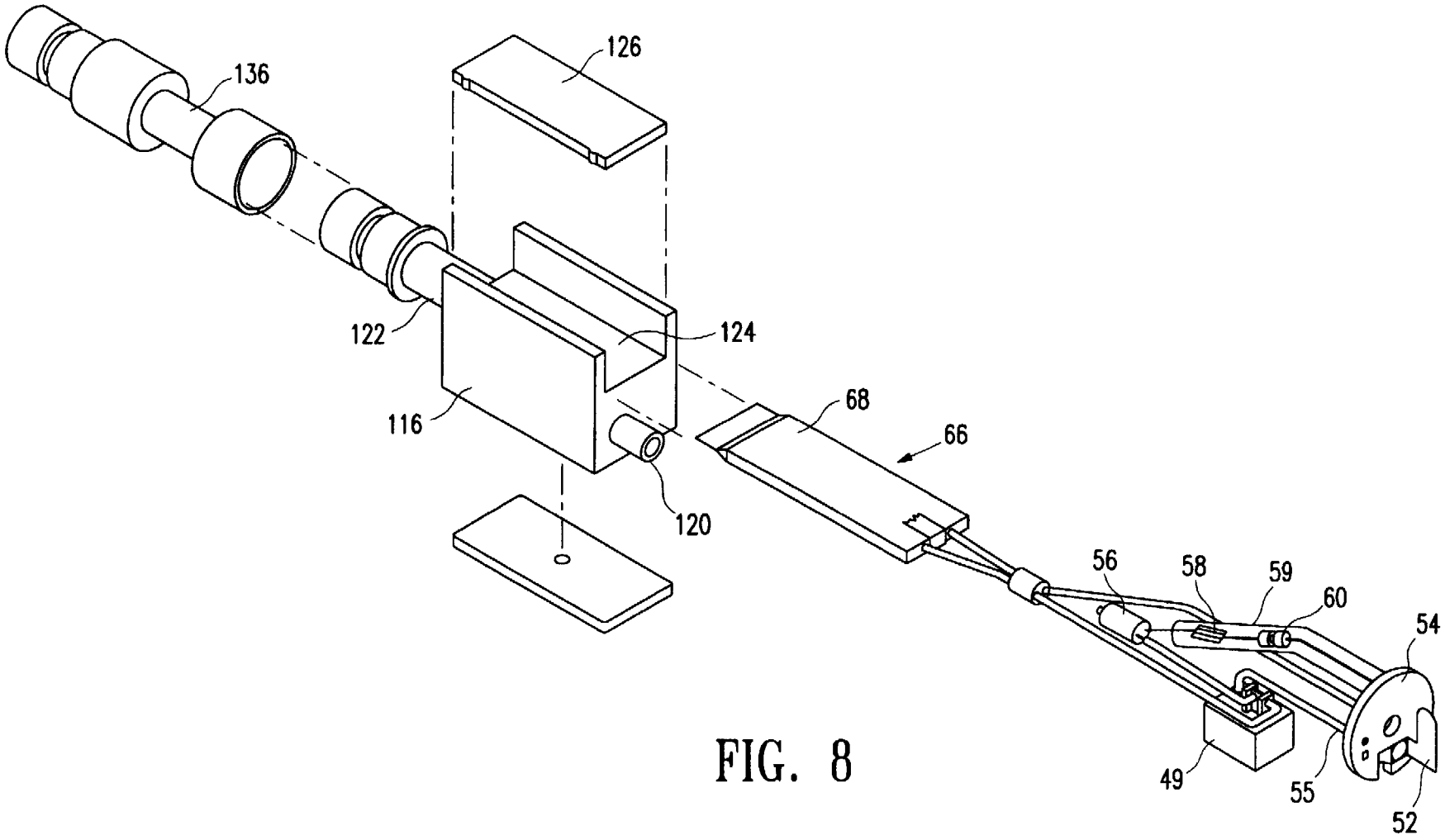
FIG. 8 is an exploded view of a heating enclosure, a heating device and electrical circuitry to help energize the heating device.

Referring now to FIGS. 5 and 8, the electrical portion of the apparatus will be described in more detail. The electric cord connects to an electric power source (not shown) through the usual wall socket. The terminus of the electric cord is a swivel base 50 which allows the cord to rotate relative to the handle and thus, facilitates the handling of the apparatus. The swivel base is connected to a swivel contact 52 which in turn is fixed to a contact support plate 54. The plate, in turn, is connected by a wire 55 to the on-off switch 49. The switch is connected by a suitable wire to a neon lamp 56 which will activate when the switch is turned to its "on" position. In this way a user is provided with an indication when the apparatus is in its "on" mode. Completing the neon lamp portion of the circuit is a wire connected to an autosplice 58, another wire connected to a resistor 60 and the last wire connecting the resistor to the contact support plate. The autosplice, resistor and accompanying wires are encased in a PVC tube 59 to prevent any short circuit with other conductors or metal parts.

The switch also has a wire leading from it to a thermistor assembly 66. Briefly, the thermistor is constructed of a sandwich including two contact plates wrapped in a capton film which is secured by capton tape 68. The thermistor assembly may be purchased from DBK Technologies, Ltd., model EB01.

Figure 6:
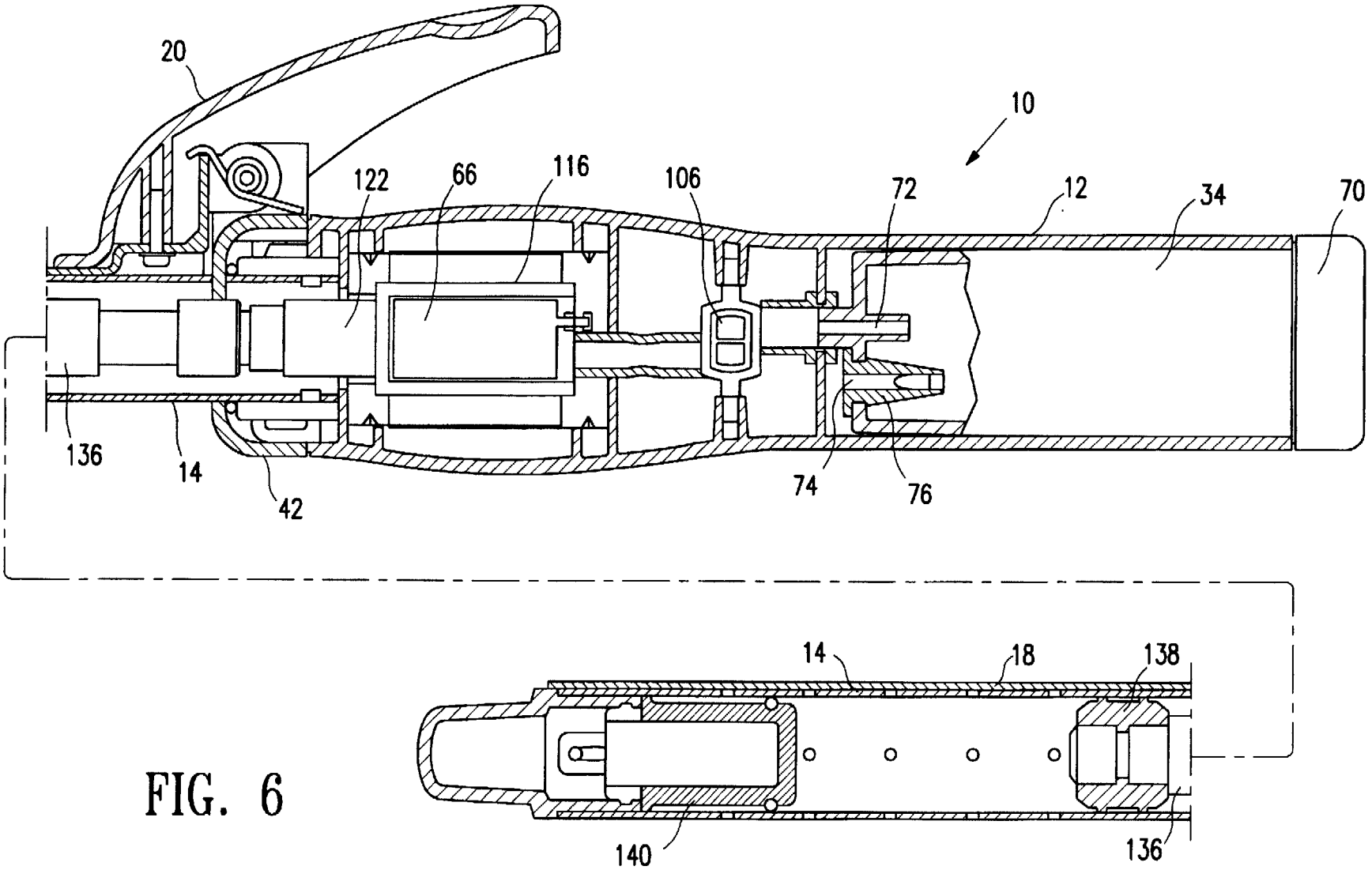
FIG. 6 is a sectional elevational view of the apparatus shown in FIGS. 1, 2 and 3 taken along line 6—6 of FIG. 1.
Figure 7:
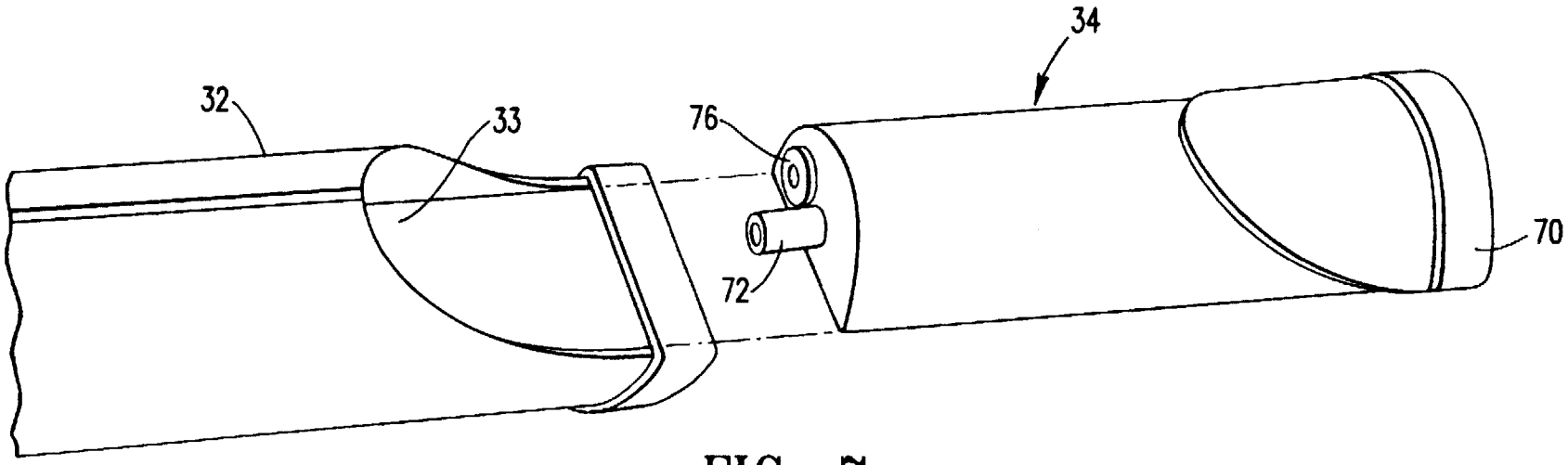
FIG. 7 is an exploded view of a water reservoir and a portion of the handle of the apparatus of the present invention.

Reference is now made to FIGS. 5, 6 and 7 for a detailed description of the water reservoir 34. The water reservoir has a generally semi-cylindrical shape and is intended to slidably engage the handle. This allows the water reservoir to be easily filled with tap water when necessary.

At one end of the reservoir is a cap 70 which is affixed to the reservoir in any convenient way such as by ultrasonic welding. At the opposite end of the water reservoir is a water outlet port 72 and a filler opening 74. Normally, the filler opening is closed by a plug 76 which also is a one way valve allowing liquid to move into the reservoir but not out of it. Adjacent the cap 70 and internal of the reservoir is a diaphragm 78 which has an outlet port 80 and an inlet opening 82. The diaphragm effectively divides the reservoir into a large chamber 84 and a small chamber 86. An internal hose 88 communicates the outlet port 72 of the reservoir with the outlet port 80 of the diaphragm 78. With this configuration, water is drawn only from the small chamber 86.

The configuration of the diaphragm not only divides the internal space of the reservoir, but the inlet opening 82, having a conical shape with the large end facing the large chamber and the small end being located in the small chamber, means that water may easily flow into the small chamber but not out of it. Because the apparatus may be placed in different attitudes when being used water will easily flow from the large chamber of the reservoir into the small chamber and will mostly remain there until the water is pumped out of the small chamber through the diaphragm outlet port 80, through the internal hose 88 and out of the port 72.

The water reservoir is made of polycarbonate, the same as the handle, though it may be transparent to allow a user to gauge the amount of water remaining. The diaphragm may be made of polypropylene while the plug/one-way valve may be made of silicon rubber.

Referring now to FIGS. 5 and 6, the steam activation switch 24 is described in more detail. The switch is comprised of a number of elements and acts as a pump to transfer water from the small chamber of the water reservoir to an enclosure for heating the water. The switch/pump is the means for communicating water from the water containing reservoir to the heating enclosure. The mechanism includes a push button 90 mounted on two end springs 92 and 94 and a centrally located bellows 96. The other end of the bellows is attached to a holder element 98 by a seal ring 100. Within the bellows is coil spring 102. Connected to the holder element is an inlet-outlet connector 104 and a dual one-way valve element 106. The dual one-way valve element includes two one-way valves, one which allows water to enter the bellows from the water reservoir, while the other allows water from the bellows to pass to the heating element. Hence, the two one-way valves are identical except they are positioned in opposite directions.

The holder element 98 includes two openings, one of which receives the one-way valve that allows water to travel from the water reservoir into the bellows. In a similar manner, the inlet-outlet connector also has two openings, and one of these openings contains the one-way valve that allows water to pass from the bellows to the heating element. The connector 104 includes a connector inlet port 108 and a connector outlet port 110 which communicate with the appropriate one-way valve. Connecting the inlet port 108 of the connector and the outlet port 72 of the water reservoir is an inlet hose 112. Connecting the outlet port 110 of the connector with the heating element is an outlet hose 114.

In operation, when the push button is depressed, water in the bellows is forced through the one-way valve into the connector and out the outlet port. Once pressure is released from the push button, the end springs and coil springs bias the push button back to its starting position and expand the bellows at the same time. The expanding bellows creates a low pressure region which draws water through one of the one-way valves from the connector inlet port.

The connector and holder may be made of polycarbonate while the dual one-way valve element may be silicon rubber. The bellows, the outlet hose and the inlet hose may also be made of silicon rubber. The springs may be made of stainless steel wire while the seal ring may be of oil resistant rubber.

The means for forming a heating chamber may be seen by once again referring to FIGS. 5 and 6 and to FIG. 8. The steam chamber 115 is formed by an enclosure 116 having internal baffles 118. The enclosure includes an inlet port 120 and an outlet port 122. To one side of the enclosure, a recess 124 is formed for receiving the thermistor 66. To position the thermistor, a mounting plate 126 is provided. The enclosure, thermistor and mounting plate are all supported by a frame 128, all located within the handle. Positioned around the enclosure is a mica liner 130 to act as a heat insulator. Positioned about the enclosure and support frame is a second mica liner 132 which offers additional heat insulation. The purpose of the two mica liners is to prevent the outside of the handle from becoming too warm because it is contemplated that the thermistor will have a surface temperature of about 260° centigrade.

Within the enclosure, there is a coating 134 for the purpose of accelerating the generation of steam. The coating spreads the water quickly and uniformly into a thin film on the baffles, whereby the water will have maximum exposure to the heat in the chamber. The chamber is sealed by a sealant to prevent water leakage.

The inlet port 120 of the enclosure is connected to the hose 114 which in turn connects to the outlet port 110 of the connector. At the other end of the enclosure, the outlet port 122 which has an elongated tubular shape, is connected to an extension tube 136 that is supported and insulated by a sealing element 138. As can be seen from the drawing, the extension tube directs heated water vapor from the steam chamber to the openings in the tube 14. The sealing element 138 insures that the water vapor or any condensed water does not flow upstream back into the enclosure.

At the other end of the perforated tube is another sealing element 140 to ensure that the water vapor or condensed water escapes through the perforations and does not flow toward the end of the perforated tube. The end of the tube is kept at a cooler temperature by its isolation from the steam.

It is contemplated that the enclosure and the extension tube will be constructed of aluminum which is a good conductor of heat from the thermistor. The mounting plate and the support frame are also of aluminum. The sealing elements are of silicon rubber.

To activate, a user moves the switch 22 to its "on" position. When this happens, the internal electrical circuitry provides power to a neon light which indicates to the user that the apparatus is in its "on" mode, and power is also transmitted to the thermistor for heating the steam chamber.

Water residing in the water reservoir may be pumped to the steam chamber by the finger or thumb operated push button 24. When the push button is pressed, water in the bellows is discharged through the first one-way valve into the steam chamber where it is quickly heated and directed by expansion through the extension tube to the perforations of the perforated tube. When the push button is released, the end springs and the coil spring bias the bellows and push button back to their original positions, thereby allowing water to be sucked into the bellows through the second one-way valve in communication with the water reservoir.

What has been described is a safe, relatively simple and relatively inexpensive hair-care apparatus which allows heated water vapor to be provided to the user's hair in an easy and quick fashion.

I claim:

1. A hand-held steam dispensing hair-care apparatus comprising:

a handle housing;

a tube connected to said handle housing, said tube having a plurality of radial openings;

means connected to said handle housing for communicating with a source of electric power;

a water reservoir removably connected to said handle housing, said reservoir including an inlet port, an outlet port and means positioned within the reservoir for dividing said reservoir into a large chamber and a small chamber, said dividing means having an outlet port and a conically shaped inlet port;

means connected to said handle housing for forming a heating enclosure;

means connected to said handle housing for communicating water from said water reservoir to said heating enclosure means;

means connected to said handle housing and said electric power communicating means for heating said heating enclosure means; and means connected to said handle housing for communicating heated water vapor from said heating enclosure means to said tube whereby a user of said apparatus is able to provide heated water vapor to his/her hair in a safe and convenient manner.

2. An apparatus as claimed in claim 1 wherein:

said means for communicating water from said water containing means to said heating enclosure means includes a bellows, a spring for biasing said bellows to an expanded position, two one-way valves in communication with said bellows and a hose connector communicating with said bellows and said two one-way valves, wherein when said bellows is compressed, water in the bellows moves through one of the two one-way valves into the hose connector and when the bellows is expanded, water moves from said hose connector through the second of said two one-way valves into said bellows.

3. An apparatus as claimed in claim 1 wherein:

said means for heating said heating enclosure means comprises a thermistor, an electrical contact, a switch and wires connecting said switch, said contact and said thermistor.

4. An apparatus as claimed in claim 1 wherein:

said heating means includes a thermistor, an electrical contact, a switch and wires connecting said switch, said contact and said thermistor.

5. An apparatus as claimed in claim 4 wherein:

said means for communicating water from said water containing means to said heating enclosure means includes a bellows, a spring for biasing said bellows to an expanded position, two one-way valves in communication with said bellows and a hose connector communicating with said bellows and said two one-way valves, wherein when said bellows is compressed, water in the bellows moves through one of the two one-way valves into the hose connector when the bellows is expanded, water moves from said hose connector through the second of said two one-way valves into said bellows.

6. An apparatus as claimed in claim 5 including:

a hose connecting the hose connector and said water containing means; and a second hose connecting said hose connector and said heating enclosure means.

7. An apparatus as claimed in claim 6 wherein:

said handle housing includes a cavity; and said water reservoir slidably engages said handle housing and is received in said cavity.

8. An apparatus as claimed in claim 4 wherein:

said handle housing includes a cavity; and said water reservoir slidably engages said handle housing and is received in said cavity.

9. An apparatus as claimed in claim 1, including:

a hose located within said large chamber connecting the outlet port of said dividing means to the outlet port of said reservoir.

10. An apparatus as claimed in claim 9 wherein:

said handle housing includes a cavity;

said water reservoir slidably engages said handle housing and is received in said cavity.

* * * * *